US005630199A

United States Patent [19]

To

[11] Patent Number: 5,630,199

[45] Date of Patent: May 13, 1997

[54] RECIPROCATION BRUSH CONTACT CHARGER

[75] Inventor: Ki-Jae To, Suwon, Rep. of Korea

[73] Assignee: SamSung Electronics Co., Ltd., Suwon, Rep. of Korea

[21] Appl. No.: 554,708

[22] Filed: Nov. 7, 1995

[30] Foreign Application Priority Data

Nov. 8, 1994 [KR] Rep. of Korea ..... 29181/1994

[51] Int. Cl.[6] ..... G03G 15/02

[52] U.S. Cl. ..... 399/175; 361/225

[58] Field of Search ..... 355/219; 362/225; 399/175

[56] References Cited

U.S. PATENT DOCUMENTS 4,547,060 10/1985 Lindblad ..... 355/219
5,398,102 3/1995 Wada et al. ..... 355/219

FOREIGN PATENT DOCUMENTS 3-120564 5/1991 Japan ..... 355/219
6-051609 2/1994 Japan ..... 355/219

*Primary Examiner*—John H. Pendegrass
*Attorney, Agent, or Firm*—Robert E. Bushnell, Esq.

[57] ABSTRACT

A brush contact charger charges a photosensitive drum of an image forming apparatus adopting an electrostatic recording system, and has a body having a brush for contacting a photosensitive drum and then charging the photosensitive drum, a reciprocating portion for reciprocating the body perpendicularly with respect to the proceeding direction of the photosensitive drum, and a guide member for supporting the body while guiding the reciprocal movement of the body. The charger charges the surface of the photosensitive drum while moving at a right angle with respect to the proceeding direction of the photosensitive drum and charges the surface of the photosensitive drum to an electrical potential having a nearly uniform distribution.

21 Claims, 5 Drawing Sheets

RECIPROCATION BRUSH CONTACT CHARGER

CROSS REFERENCE TO RELATED APPLICATIONS

This application makes reference to, incorporates the same herein, and claims all benefits accruing under 35 U.S.C §119 from an application entitled Brush Contact Charger earlier filed in the Korean Industrial Property Office on 8 Nov. 1994, which was duly assigned Ser. No. 94-29181 by that Office.

BACKGROUND OF THE INVENTION

The present invention relates to a charger for charging a photosensitive drum of an image forming apparatus, and more particularly, to a brush contact charger for charging the surface of a photosensitive drum at a nearly uniform electrical potential in an image forming apparatus adopting a charging system that employs a brush contact method.

In an image-forming apparatus using electrophotography to form an electrostatic latent image, the image forming apparatus uses high voltage to uniformly charge a photosensitive drum, exposes the photosensitive drum, and then terminates the charge. Then, the latent image is developed by an electrically charged toner and the developed image is fixed to a print medium by heating and pressing.

Meanwhile, most image forming apparatuses in current use adopt a corona discharging system employing a high voltage application as the method for charging the surface of a photosensitive drum. The corona discharging system, however, generates ozone ($O_3$), which causes environmental problems. Accordingly, a charging system employing a brush contact method has recently been under study.

Conventionally, a charger is electrically connected to a power supply and is installed so that a brush contacts a surface of a photosensitive drum which rotates together with a developing roller. Here, when voltage is applied from the power supply, the charger charges the surface of the photosensitive drum at a predetermined electrical potential via the brush.

As the charger is electrified however, the conductive fibers of the brush do not contact the surface of the photosensitive drum consistently, due to subtle length variations thereof. Further, it is difficult to maintain a regular spacing between the fibers. Thus, electrical potential varies across the surface of the photosensitive drum, and the photosensitive drum's surface is charged unevenly. This uneven charging degrades the quality of the final image.

SUMMARY OF THE INVENTION

Accordingly, it is an object of the present invention to provide a brush contact charger for uniformly charging a surface of a photosensitive drum of an image forming apparatus.

To accomplish the above object, there is provided a brash contact charger for charging a photosensitive drum of an image forming apparatus, the brush contact charger comprises a body having a brush for contacting and then charging the photosensitive drum, wherein the body is moved in a back and forth direction with respect to the longitudinal axis of the photosensitive drum, i.e., perpendicular to the rotating direction of the photosensitive drum, and a guide member for supporting the body while guiding the reciprocal movement of the body.

Since the above brush contact charger moves at a right angle with respect to the rotating direction, i.e., the proceeding direction, of the photosensitive drum, while charging the surface thereof, the surface of the photosensitive drum can be charged at a nearly uniform electrical potential.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
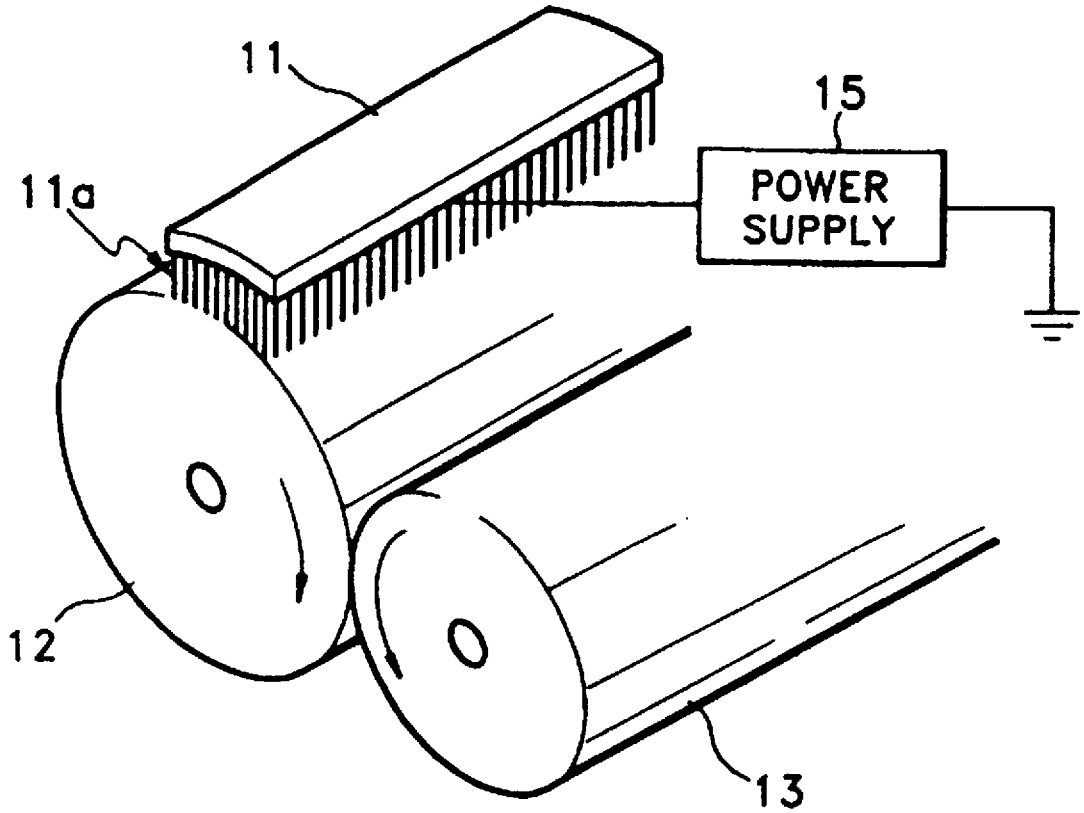
FIG. 1 is a simplified schematic illustrating a charger adopting the brush contact method in an image forming apparatus.

Referring to FIG. 1, a charger 11 is electrically connected to a power supply 15 and is installed so that a brush 11*a* contacts the surface of a photosensitive drum 12 which rotates together with a developing roller 13. Here, when voltage is applied from power supply 15, charger 11 charges the surface of photosensitive drum 12 at a predetermined electrical potential via brush 11*a*.

Figure 2:
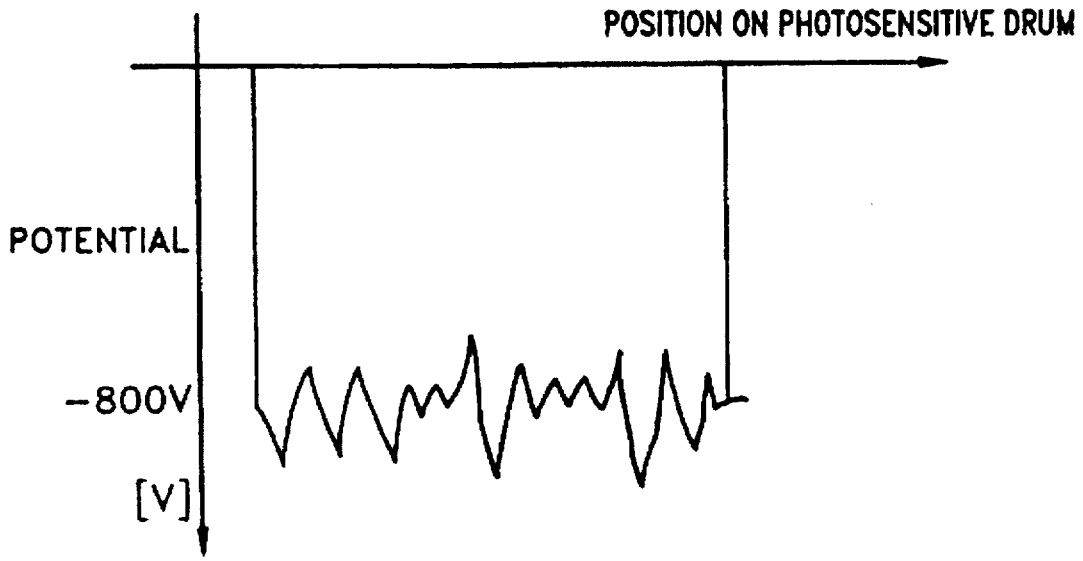
FIG. 2 illustrates the electrical potential for each position along a photosensitive drum used in an image forming apparatus adopting the brush contact system of FIG. 1.

However, as charger 11 is electrified, the conductive fibers of brush 11*a* do not contact the surface of photosensitive drum 12 consistently, due to subtle length variations thereof. Further, it is difficult to maintain a regular spacing between the fibers. Thus, as shown in FIG. 2, a graph illustrates the varying electrical potential across the surface of photosensitive drum 12, indicating that the photosensitive drum's surface is charged unevenly. This uneven charging degrades the quality of the final image.

Figure 3:
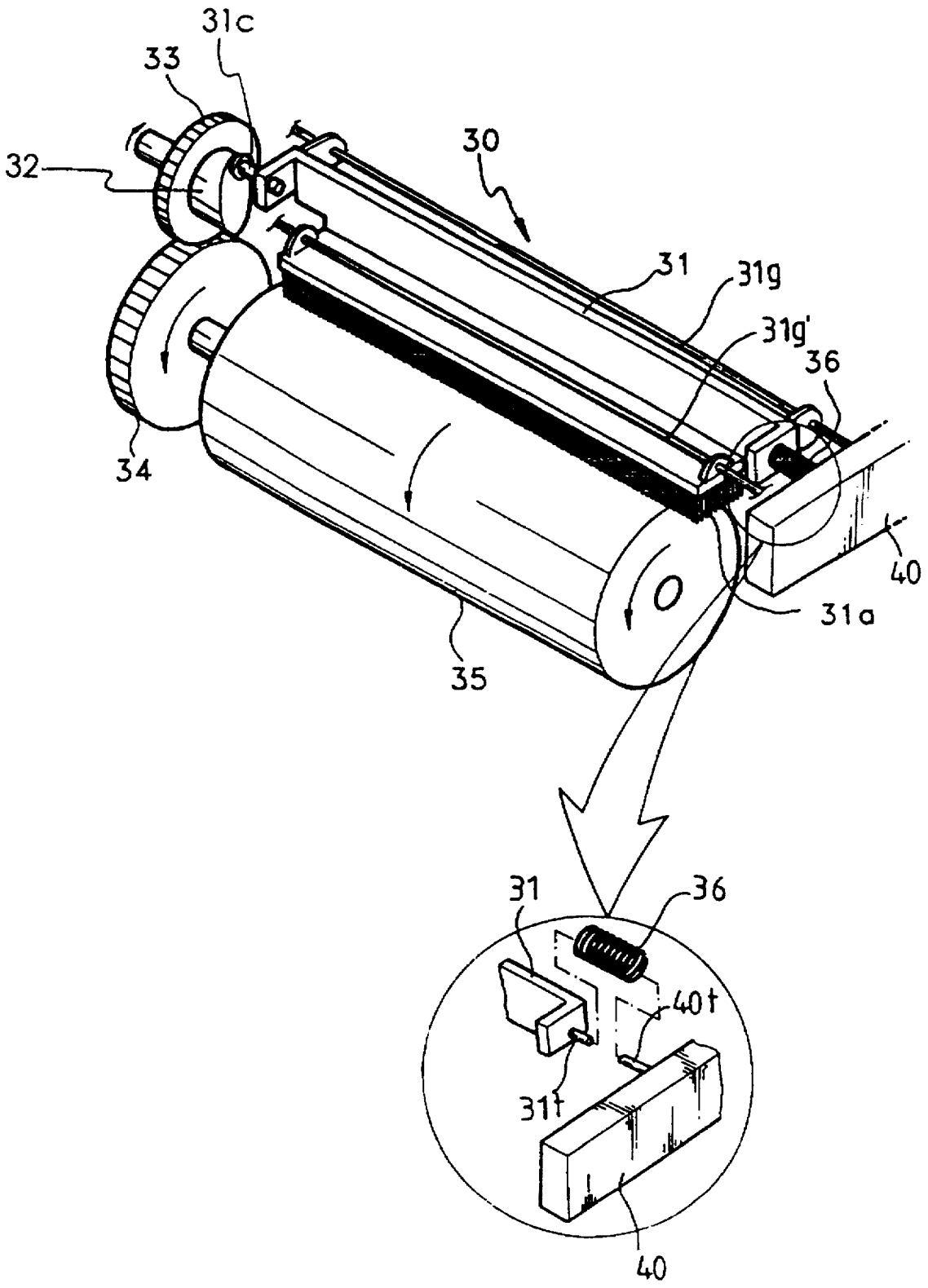
FIG. 3 schematically illustrates a brush contact charger constructed according to the principles of the present invention.

A brush contact charger 30 according to the principles of the present invention, and referring to FIG. 3, includes a charging brush 31*a* disposed adjacent to photosensitive drum 35, wherein charging brush 31*a* is attached to a body 31 electrically connected to a power supply (not shown). Body 31 is reciprocated in the longitudinal direction of photosensitive drum 35 in order to place a consistent charge on the surface of photosensitive drum 35 by moving charging brush 31*a* along the surface of photosensitive drum 35. Body 31 is slidably installed on two guide shafts 31*g* and 31*g'*. A gear 34 installed on the shaft of photosensitive drum 35 is in meshed engagement with a smaller gear 33 having a cam 32 installed thereon. Cam 32 maintains contact with cam contact member 31*c* extending from one end portion of body 31. A compression spring 36 is mounted on a protrusion 40*t* extending from a frame 40 and a protrusion 31*t* extending from an opposite end portion of body 31. The biasing force exerted by spring 36 enables cam contact member 31*c* to maintain contact with cam 32. The rotation of gear 34 causes gear 33 and cam 32 to rotate thus driving body 31 along shafts 31*g* and 31*g*' and against the biasing force of compression spring 36. Thus the combination of the rotation of cam 32 and the compression/decompression of spring 36 enables body 31 and brush 31*a* to move in a reciprocating manner along rotating photosensitive drum 35.

Figure 4A:
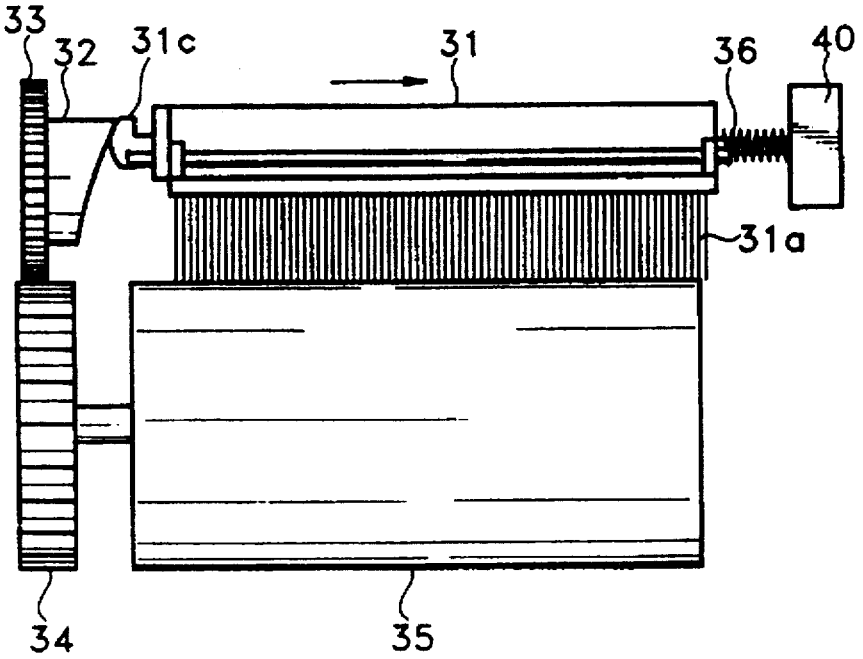
FIGS. 4A and 4B show operation of the brush contact charger constructed according to the principles of the present invention.

The operation of the thus-structured brush contact charger of the present invention will be explained with reference to FIGS. 3, 4A and 4B.

When power is supplied by a power supply (not shown) to charger 30, photosensitive drum 35 is charged by brush 31*a*. Here, the rotation of photosensitive drum 35 causes the rotation of gear 34 installed onto the shaft of photosensitive drum 35. Accordingly, gear 33, which is meshed with gear 34, rotates simultaneously with gear 34. Consequently, cam 32, which is fixed to gear 33, rotates so that body 31 of charger 30 moves reciprocally in accordance with the rotation of cam 32, as shown in FIGS. 4A and 4B. In other words, as shown in FIG. 4A, cam 32 rotates, and thus the peak of cam 32 contacts cam contact 31*c* of body 31 of charger 30 so as to push cam contact 31*c*. Then, body 31 moves in the direction of the arrow (FIG. 4A) along guide shafts 31*g* and 31*g*'. At this time, body 31 compresses spring 36 to resiliently bias body 31. In the meantime, as shown in FIG. 4B, when cam 32 continues its rotation so that the recess thereof comes into play, body 31 of charger 30 moves in the direction of the arrow shown in FIG. 4B in response to the resilient (decorepressing) force of spring 36.

Figure 5:
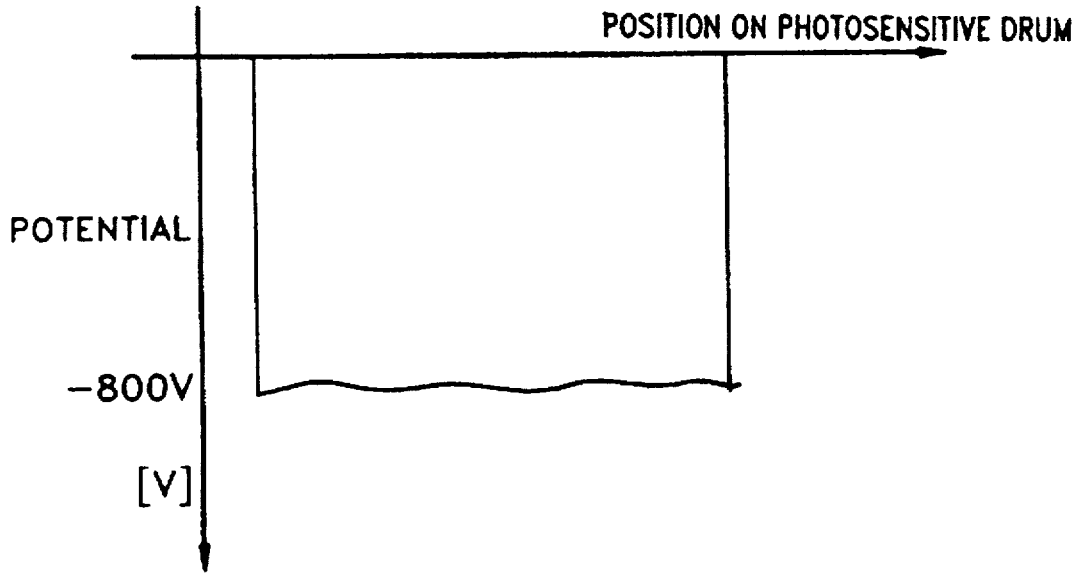
FIG. 5 illustrates the electrical potential for each position along a photosensitive drum, by using the brush contact charger according to the principles of the present invention.

As such serial operations repeat, body 31 of the charger reciprocates at a right angle with respect to the rotating direction of photosensitive drum 35, and brush 31*a* charges the surface of photosensitive drum 35 while moving on the surface of photosensitive drum 35 according to a reciprocating movement. Therefore, as shown in FIG. 5, the surface of photosensitive drum 35 is charged at a nearly uniform electrical potential.

Figure 4B:
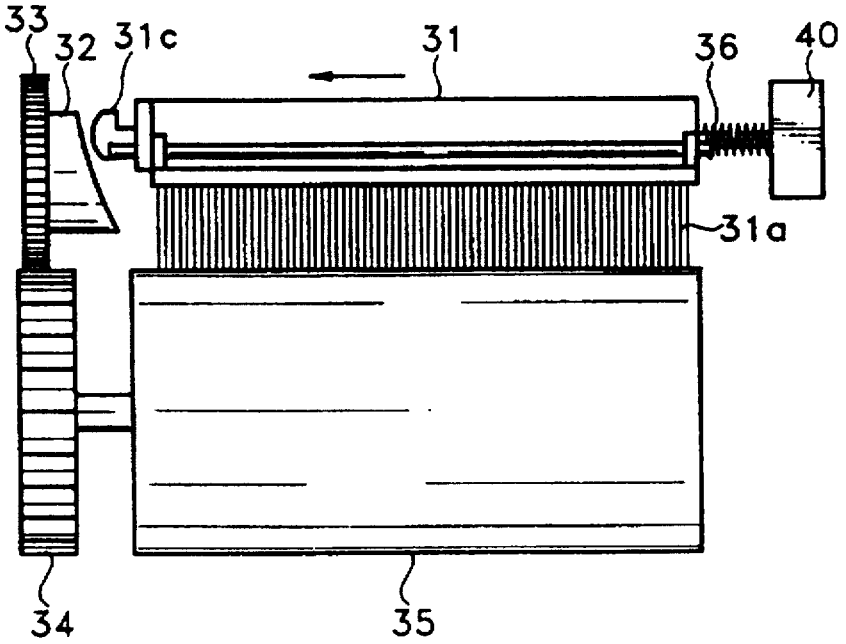

Cam 32 in FIGS. 3–4B has an slightly undulated contacting surface so that, during rotation of cam 32, brush 31*a* maintains a uniformly accelerated motion across the surface of photosensitive drum 35 for charging the surface with a nearly uniform electrical potential. Thus, brush 31*c* will make one uniform reciprocal motion across photosensitive drum 35 as cam 32 makes one complete cycle.

Figure 6:
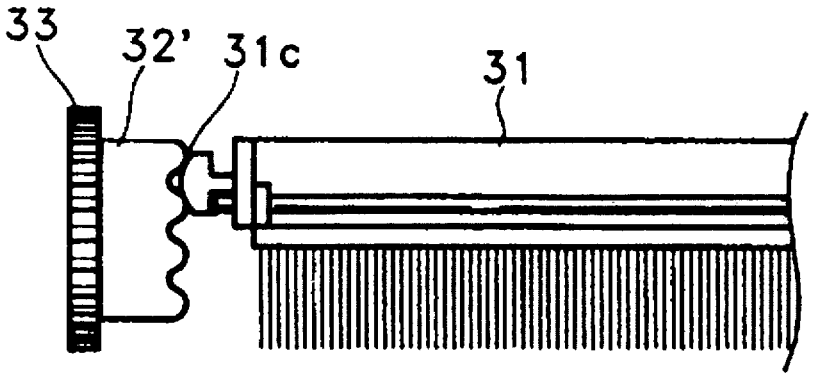
FIG. 6 is a partially extracted view showing another embodiment of the cam for use in the brush contact charger constructed according to the principles of the present invention.

As shown in FIG. 6, however, a cam 32', which has more undulations in the contact surface than cam 32, can be employed to increase the frequency of the reciprocating movement of body 31. Here, when cam 32 is substituted with cam 32' of FIG. 6, body 31 can be reciprocated at a much greater frequency, to improve the uniform charging effect of brush 31*a*, accordingly, and provide increased uniformity in the electrical potential distribution on the surface of photosensitive drum 35.

As described above, a brush contact charger of the present invention moves at a right angle with respect to the proceeding (rotating) direction of a photosensitive drum and charges the surface of a photosensitive drum. Accordingly, the surface of the photosensitive drum can be charged to an electrical potential with a nearly uniform distribution. Therefore, the photosensitive drum can obtain a more uniform distribution of toner resulting in a better image which can be obtained when the present invention is employed for an image forming apparatus.

While there have been illustrated and described what is to he considered to be the preferred embodiment of the present invention, it will be understood by those skilled in the art that various changes and modifications may be made, and equivalents may be substituted for elements thereof without departing from the true scope of the present invention. Therefore, it is intended that the present invention not be limited to the particular embodiment disclosed as the best mode contemplated for carrying out the present invention, but that the present invention includes all embodiments falling within the scope of the appended claims.

What is claimed is:

1. A brush contact charger for charging a photosensitive drum of an image forming apparatus of an electrostatic recording system, said brush contact charger comprising:
   - a body having a brush disposed to be in contact with said photosensitive drum, said brush providing an electrostatic charge to said photosensitive drum;
   - reciprocating means for vibrating said body perpendicularly with respect to a rotating direction of said photosensitive drum, said reciprocating means comprising:
     - a first gear installed on a rotational shaft of said photosensitive drum, said first gear being rotated in dependence upon rotation of said rotational shaft;
     - a second gear engagedly meshed with said first gear, said second gear being rotated simultaneously with said first gear;
     - a cam fixed to said second gear, said cam being rotated simultaneously with said second gear for moving said body in a first direction; and
     - biasing means for moving said body in a second direction opposite to said first direction.

2. The reciprocating means as set forth in claim 1, said cam comprising an undulated surface for enabling uniform reciprocal movement of said body.

3. The reciprocating means as set forth in claim 1, said biasing means comprising a compression spring.

4. A brush contact charger for charging a photosensitive drum of an image forming apparatus adopting an electrostatic recording system, said brush contact charger comprising:
   - a body having a brush disposed to be in contact with said photosensitive drum, said brush providing an electrostatic charge to said photosensitive drum;
   - means for reciprocating said body perpendicularly with respect to a rotating direction of said photosensitive drum, said means for reciprocating comprising:
     - a first gear installed on a rotational shaft of said photosensitive drum, said first gear being rotated in dependence upon rotation of said rotational shaft;
     - a second gear engagedly meshed with said first gear, said second gear being rotated simultaneously with said first gear;
     - a cam fixed to said second gear, said cam being rotated simultaneously with said second gear for moving said body in a first direction; and
     - biasing means for moving said body in a second direction opposite to said first direction; and
   - guide means for slidably supporting said body during reciprocal movement of said body.

5. The brush contact charger as set forth in claim 4, said cam comprising an undulated surface for enabling uniform reciprocal movement of said body.

6. The brush contact charger as set forth in claim 4, said biasing means comprising a compression spring.

7. The brush contact charger as set forth in claim 4, said guide means comprising a pair of shafts.

8. A charging apparatus, comprising:

a brush contact charger for charging a photosensitive drum of an image forming apparatus, said brush contact charger comprising:

a body, a brush connected to said body and in contact with said photosensitive drum for providing an electrostatic charge to said photosensitive drum, and reciprocating means for moving said body in a direction perpendicular to a rotating direction of said photosensitive drum, said reciprocating means comprising:

a first gear installed on a rotational shaft of said photosensitive drum, said first gear rotating in dependence upon rotation of said rotational shaft;

a second gear engagedly meshed with said first gear, said second gear being rotated simultaneously with said first gear;

a cam fixed to said second gear, said cam being rotated simultaneously with said second gear for moving said body in a first direction, said cam comprising an undulated surface for enabling uniform reciprocal movement of said body; and biasing means for moving said body in a second direction opposite said first direction.

9. The reciprocating means as set forth in claim 8, said biasing means comprising a compression spring.

10. The reciprocating means as set forth in claim 8, said undulated surface of said cam comprising a plurality of undulations for reciprocating of said body a plurality of times during a single rotation of said first gear.

11. A brush contact charger for charging a photosensitive drum of an image forming apparatus adopting an electrostatic recording system, said brush contact charger comprising:

brush means having a body portion and a brush portion connected to said body portion, said brush portion contacting a surface portion of said photosensitive drum for providing an electrostatic charge to said surface portion of said photosensitive drum; and means for reciprocally moving said brush means in a longitudinal direction of said photosensitive drum, said means for reciprocally moving said brush means comprising:

a first gear installed on a rotational shaft of said photosensitive drum, said first gear being rotated in dependence upon rotation of said rotational shaft;

a second gear engagedly meshed with said first gear, said second gear being rotated simultaneously with said first gear;

a cam fixed to said second gear, said cam being rotated simultaneously with said second gear;

cam contact means extending from one end of said body portion for maintaining contact with said cam for moving said brush means in a first direction; and biasing means extending from an opposite end of said body portion for moving said brush means in a second direction opposite said first direction; and guide means for slidably supporting said body portion during reciprocal movement of said brush means.

12. The brush contact charger as set forth in claim 11, said cam comprising an undulated surface for enabling uniform reciprocal movement of said body portion.

13. The brush contact charger as set forth in claim 12, said undulated surface of said cam comprising a plurality of undulations for reciprocally moving said brush means a plurality of times during a single rotation of said first gear.

14. The brush contact charger as set forth in claim 11, said biasing means comprising a compression spring.

15. The brush contact charger as set forth in claim 11, said guide means comprising a pair of shafts.

16. The brush contact charger as set forth in claim 11, said body portion comprising a horizontal member and a vertical member, said brush portion being connected to said horizontal member.

17. The brush contact charger as set forth in claim 11, said body portion comprising a horizontal member and a vertical member, said brush portion being attached to said horizontal member, said cam contact means being connected to a first end of said vertical member and said biasing means being connected to a second end of said vertical member.

18. The brush contact charger as set forth in claim 17, said guide means comprising a pair of shafts, a first one of said pair of shafts being slidably engaged with said horizontal member and a second one of said shafts being slidably engaged with said vertical member.

19. A charging apparatus, comprising:

a brush contact charger for charging a photosensitive drum of an image forming apparatus, said brush contact charger comprising:

a body, a brush connected to said body and in contact with said photosensitive drum for providing an electrostatic charge to said photosensitive drum, and reciprocating means for moving said body in a direction perpendicular to a rotating direction of said photosensitive drum, said reciprocating means comprising:

a first gear installed on a rotational shaft of said photosensitive drum, said first gear being rotated in dependence upon rotation of said rotational shaft;

a second gear engagedly meshed with said first gear, said second gear being rotated simultaneously with said first gear;

a cam fixed to said second gear, said cam being rotated simultaneously with said second gear for moving said body in a first direction;

biasing means for moving said body in a second direction opposite said first direction; and a pair of shafts slidably engaged with said body and slidably supporting said body during reciprocal movement of said body.

20. The reciprocating means as set forth in claim 19, said cam comprising an undulated surface for enabling uniform reciprocal movement of said body.

21. The reciprocating means as set forth in claim 20, said undulated surface of said cam comprising a plurality of undulations for reciprocating of said body a plurality of times during a single rotation of said first gear.

* * * * *

UNITED STATES PATENT AND TRADEMARK OFFICE

CERTIFICATE OF CORRECTION

PATENT NO. : 5,630,199
DATED : May 13, 1997
INVENTOR(S) : Ki-Jae TO

It is certified that error appears in the above-indentified patent and that said Letters Patent is hereby corrected as shown below:

On THE TITLE PAGE

| | | |
|---|---|---|
| Title (item) [54], | | change the title "RECIPROCATION BRUSH CONTACT CHARGER" to read --RECIPROCATING BRUSH CONTACT CHARGER--: |
| Column 1, | Line 1, | change the title to read --RECIPROCATING BRUSH CONTACT CHARGER--; and |
| Column 3, | Line 33, | after "resilient", change "(decorepressing)" to --(decompressing)--: |

Signed and Sealed this

Twelfth Day of August, 1997

Bruce Lehman

*Attest:*

BRUCE LEHMAN

*Attesting Officer*

*Commissioner of Patents and Trademarks*